US008038040B2

(12) United States Patent
Dennis

(10) Patent No.: US 8,038,040 B2
(45) Date of Patent: Oct. 18, 2011

(54) BOTTLE WITH INTEGRAL DIP TUBE

(75) Inventor: Stephen R. Dennis, Danville, CA (US)

(73) Assignee: The Clorox Company, Oakland, CA (US)

( * ) Notice: Subject to any disclaimer, the term of this patent is extended or adjusted under 35 U.S.C. 154(b) by 344 days.

(21) Appl. No.: 12/254,132

(22) Filed: Oct. 20, 2008

(65) Prior Publication Data

US 2010/0096415 A1 Apr. 22, 2010

(51) Int. Cl.
*B67D 7/78* (2010.01)

(52) U.S. Cl. ..... 222/464.1; 222/382

(58) Field of Classification Search ..... 222/464.1, 222/382, 321.7–321.9, 211
See application file for complete search history.

(56) References Cited

U.S. PATENT DOCUMENTS

| | | | | |
|---|---|---|---|---|
| 2,423,220 | A | 7/1947 | William | |
| 2,573,954 | A | 11/1951 | Casson | |
| 3,575,949 | A | 4/1971 | Humphrey | |
| 4,863,071 | A | 9/1989 | Guss et al. | |
| RE33,480 | E * | 12/1990 | Guss et al. | 222/207 |
| 5,192,007 | A | 3/1993 | Blomquist | |
| 5,246,146 | A | 9/1993 | Bartimes et al. | |
| 5,303,851 | A | 4/1994 | Libit | |
| 5,439,141 | A * | 8/1995 | Clark et al. | 222/136 |
| 5,464,129 | A * | 11/1995 | Ho | 222/377 |
| 5,479,970 | A | 1/1996 | Trani | |
| 5,542,581 | A | 8/1996 | Habora et al. | |
| 5,558,257 | A * | 9/1996 | Braun | 222/212 |
| 5,570,840 | A | 11/1996 | Gettinger et al. | |
| 5,638,994 | A * | 6/1997 | Libit et al. | 222/207 |
| 5,829,640 | A | 11/1998 | Hershey et al. | |
| 5,890,624 | A | 4/1999 | Klima et al. | |
| 5,947,341 | A | 9/1999 | Montaner et al. | |
| 6,032,814 | A | 3/2000 | Foster | |
| 6,123,230 | A | 9/2000 | Klima et al. | |
| 6,213,358 | B1 * | 4/2001 | Libit et al. | 222/633 |
| 6,264,058 | B1 * | 7/2001 | Porter et al. | 220/709 |
| 6,315,167 | B2 | 11/2001 | Brecheisen et al. | |
| 6,345,738 | B1 | 2/2002 | Brozell et al. | |
| 6,494,344 | B1 | 12/2002 | Kressel, Sr. | |
| 6,595,246 | B2 | 7/2003 | Brozell et al. | |
| 6,702,157 | B1 | 3/2004 | Dobbs | |
| 7,490,743 | B2 * | 2/2009 | Herzog | 222/321.7 |
| 2002/0020720 | A1 | 2/2002 | Schmid et al. | |
| 2007/0215646 | A1 | 9/2007 | Foster | |
| 2009/0212077 | A1 * | 8/2009 | Carden | 222/382 |
| 2010/0096414 | A1 | 4/2010 | Dennis | |

OTHER PUBLICATIONS

NonFinal Office Action mailed Apr. 13, 2011 for related U.S. Appl. No. 12/254,144, filed Oct. 20, 2008.

* cited by examiner

*Primary Examiner* — Kevin P Shaver
*Assistant Examiner* — Donnell Long
(74) *Attorney, Agent, or Firm* — Thomas C. Feix

(57) ABSTRACT

Described is a fluid dispensing container having a bottle and fluid withdrawing assembly for liquids, such as liquid cleaners and the like. The bottle has an integral dip tube formed therein, fluidly connecting the inside of the bottle with the top opening of the bottle. A fluid dispensing mechanism, such as a pump or trigger-sprayer, is attached to the top of the bottle to take fluid up through the integral dip tube and dispense the fluid accordingly. The fluid dispensing mechanism may be aligned to allow a direct connection between integral dip tube and the fluid dispensing mechanism. The fluid dispensing mechanism may be attached to the bottle with a snap-fit connection.

15 Claims, 8 Drawing Sheets

BOTTLE WITH INTEGRAL DIP TUBE

BACKGROUND OF THE INVENTION

1. Field of the Invention

This invention relates generally to containers and fluid withdrawing assemblies for liquids, such as liquid cleaners and the like. More particularly, the present invention relates generally to bottles having an integral supply tube formed therein.

2. Description of the Related Art

Trigger sprayers are those types of sprayers that can be held in a single hand of the user and operated by the fingers of the user's hand to pump fluid from a container connected to the trigger sprayer. A prior art trigger sprayer typically includes a sprayer housing that contains a pump chamber and piston, and a sprayer fluid supply passageway that fluidly communicates a fluid inlet opening (sometimes also referred to as a "connector aperture") with the pump chamber. The trigger sprayer further includes a finger operated trigger that actuates the pump piston. The manually manipulated trigger is mounted on the sprayer housing for pivoting movement by the fingers of the user's hand, the trigger being operatively connected to the pump piston of the trigger sprayer. Manual manipulation of the trigger operates the pump, which draws fluid from the container connected to the trigger sprayer and dispenses the fluid from the sprayer housing. A fluid discharge passageway fluidly communicates the pump chamber with a sprayer fluid outlet that discharges fluid from the sprayer housing upon actuation of the pump piston. Finally, a nozzle assembly is often connected to the sprayer housing at the sprayer fluid outlet opening.

Various types of nozzle assemblies are known. A typical nozzle assembly is adjustable to provide different discharge patterns of the fluid dispensed from the sprayer housing. For example, the fluid can be dispensed in a stream or spray pattern, or as a foam.

A sprayer connector, adapted to secure the sprayer housing to the fluid container, is typically integrally formed with or otherwise coupled to the sprayer housing. As noted above, the sprayer connector includes a connector aperture therethrough that forms the inlet opening of the fluid supply passageway to the pump chamber of the sprayer housing. A dip tube is often sealingly coupled to the connector aperture. The dip tube extends through a neck of the container and into fluid contents of the container. The dip tube fluidly communicates the container with the fluid supply passageway of the sprayer housing.

Sprayer connectors with conventional dip tubes present problems. Warped dip tubes are currently a major problem in the pump/bottle assemblies with a resultant undesired amount of scrap. The elimination of the conventional dip tube may eliminate this major problem.

By eliminating the conventional dip tube, the problem of the dip tube otherwise becoming separated from the pump is no longer an issue. Further, when the container is of the refillable type and the pump is to be removed from the container, with the elimination of the dip tube, there is no column of fluid remaining with the pump that can dribble during refill as may otherwise occur in containers with dip tubes.

U.S. Pat. No. 4,863,071 discloses a pump and container assembly which includes a dip tube which is carried by the pump and extends through a customary circular cross sectional mouth of the container. The container includes an offset supply tube for carrying the liquid from the integral dip tube to the pump assembly. Furthermore, the pump assembly may be attached to the bottle via a screw cap, thereby requiring the offset supply tube to be properly aligned with the integral dip tube prior to screwing the cap to attach the pump assembly to the bottle. To assist in this alignment, an upstanding projection may be formed in the container to prevent twisting of the pump assembly relative to the container when the screw cap is tightened. The requirements of an upstanding projection and offset supply tube may result in additional manufacturing cost. Without such an upstanding projection, the torque of tightening the screw cap onto the bottle may misalign the integral dip tube from the offset supply tube.

As discussed above, many prior art trigger sprayers, including those useful with bottles having integral dip tubes, are connected to their containers by an internally threaded sprayer connector. To firmly secure the trigger sprayer on the container neck, the sprayer connector is positioned on the container neck and rotated. Complementary screw threading provided on the inner surface of the cap and the outer surface of the container neck securely attaches the trigger sprayer to the container. These containers require a two-step process for attaching the trigger sprayer to the container neck—a first step of aligning the dip tube with the trigger sprayer and a second step of screwing the trigger sprayer onto the container neck to form a seal.

Alternatively, many trigger sprayers are connected to a container with a bayonet sprayer connector. Bayonet sprayer connectors are advantageously used where a trigger sprayer is connected to a container neck by a machine in an assembly line. Bayonet sprayer connectors of the prior art may be the well known "snap fit"type sprayer connectors that firmly attach the trigger sprayer on the container neck by merely positioning the sprayer housing above and in alignment with the container and, with the dip tube inserted through the open top of the container, pushing the trigger sprayer down on the container. Bayonet sprayer connectors typically use a standard dip tube, depending from the sprayer connector. Thus, the problems associated with standard dip tubes, as discussed above, may apply to the typical bayonet sprayer connectors currently in use.

Other prior art bayonet sprayer connectors are connected to complementary container necks by rotating the connector just a fraction of one complete revolution relative to the container neck. These types of bayonet sprayer connectors have two different movements to attach the sprayer connector on a container neck. The sprayer connector must be moved in a linear direction onto the container neck while also being rotated relative to the container neck.

Accordingly, what is needed is a bottle, with an integral dip tube, having a trigger or pump assembly that attaches to the bottle.

SUMMARY OF THE INVENTION

In accordance with the principles of the present invention, in one embodiment, a fluid dispensing container comprises an integral dip tube fluidly connecting an inside of the bottle with a top opening of the bottle; and a snap-fit fluid dispensing mechanism fluidly connected with the integral dip tube at the top opening of the bottle, wherein the snap-fit fluid dispensing mechanism attaches to the bottle with a snap-fit attachment.

According to another embodiment of the present invention, a fluid dispensing container comprises an integral dip tube fluidly connecting an inside of the bottle with a top opening of the bottle; and a fluid dispensing mechanism fluidly connected with the integral dip tube at the top opening of the bottle, wherein the dispensing mechanism includes a supply line directly connecting with the integral dip tube when the fluid dispensing mechanism is attached to the bottle.

According to a further embodiment of the present invention, a fluid dispensing container comprises an integral dip tube fluidly connecting an inside of the bottle with a top opening of the bottle; and a snap-fit fluid dispensing mechanism fluidly connected with the integral dip tube at the top opening of the bottle, wherein the snap-fit fluid dispensing mechanism attaches to the bottle with a snap-fit attachment; the snap-fit dispensing mechanism includes a supply line directly connecting with the integral dip tube when the fluid dispensing mechanism is attached to the bottle; and a trigger engine of the snap-fit fluid dispensing mechanism is located forward of the supply line.

The use of the bottle of the present invention, from a consumer perspective, would not differ from the use of any conventional trigger or pump bottle known in the art. The user would simply activate the fluid dispensing mechanism to dispense fluid from the bottle.

In one embodiment, the bottle may include a snap-fit fluid withdrawing mechanism, such as a pump or a trigger sprayer, for dispensing fluid from the container. By using a snap-fit mechanism instead of a screw-type mechanism, alignment and sealing attachment of the mechanism to the container may be achieved in a single motion. This is in contrast to the prior art screw-type mechanisms, where attachment of the mechanism to the container includes at least a first motion of alignment, which includes maintaining this alignment throughout a second motion of rotation to tighten the mechanism on the container to form a seal.

The snap-fit fluid withdrawing mechanism of the present invention may have alignment means, such as tabs and slots, to fit the trigger over the opening of the container so as to align the integral dip tube of the container with the fluid supply into the trigger or pump mechanism. In one embodiment, the trigger or pump mechanism may be designed such that the integral dip tube of the container may directly align with the fluid supply into the trigger or pump mechanism, without the need for an offset tube to fluidly connect the trigger or pump mechanism with the integral dip tube.

In yet another embodiment of the present invention, the snap-fit fluid withdrawing mechanism may be a removable snap-fit mechanism, allowing the user to refill and reuse the bottle. In another embodiment of the present invention, the snap-fit mechanism may be a non-removable snap-fit mechanism. In a further embodiment, the snap-fit mechanism may be either a removable or non-removable snap-fit mechanism having a refill channel provided therethrough.

Further features and advantages of the present invention will become apparent to those of ordinary skill in the art in view of the detailed description of embodiments below, when considered together with the attached drawings and claims.

BRIEF DESCRIPTION OF THE DRAWINGS

The foregoing aspects and others will be readily appreciated by the skilled artisan from the following description of illustrative embodiments when read in conjunction with the accompanying drawings, in which.

DETAILED DESCRIPTION

Figure 1B:
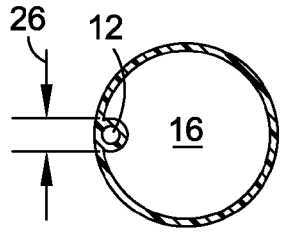
FIG. 1B shows a plan view of the bottle of FIG. 1A taken along line I-I of FIG. 1A.

Reference will now be made to the drawings wherein like numerals refer to like parts throughout. For ease of description, the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The term "bottle", as used herein, is meant to mean and include any container for holding a fluid. A bottle may be made of any suitable material, depending upon the product therein. For example, a bottle may be made of plastic.

The term "integral dip tube", as used herein, is meant to mean and include any channel formed integrally along the structure of a bottle that may carry the fluid present in the bottle. An integral dip tube may be a channel formed in a bottle running from an opening in the bottle (typically at the top, or mouth, of the bottle), along a side wall of the bottle.

Broadly, the present invention provides a bottle and fluid withdrawing assembly for liquids, such as liquid cleaners and the like. The bottle has an integral dip tube formed therein, fluidly connecting the inside of the bottle with the top opening of the bottle. A fluid dispensing mechanism, such as a pump or trigger-sprayer, may be attached to the top of the bottle to take fluid up through the integral supply tube and dispense the fluid accordingly. The fluid dispensing mechanism may be aligned to allow a direct connection between the integral supply tube and the fluid dispensing mechanism. The fluid dispensing mechanism may be attached to the bottle with a snap-fit connection.

Figure 1A:
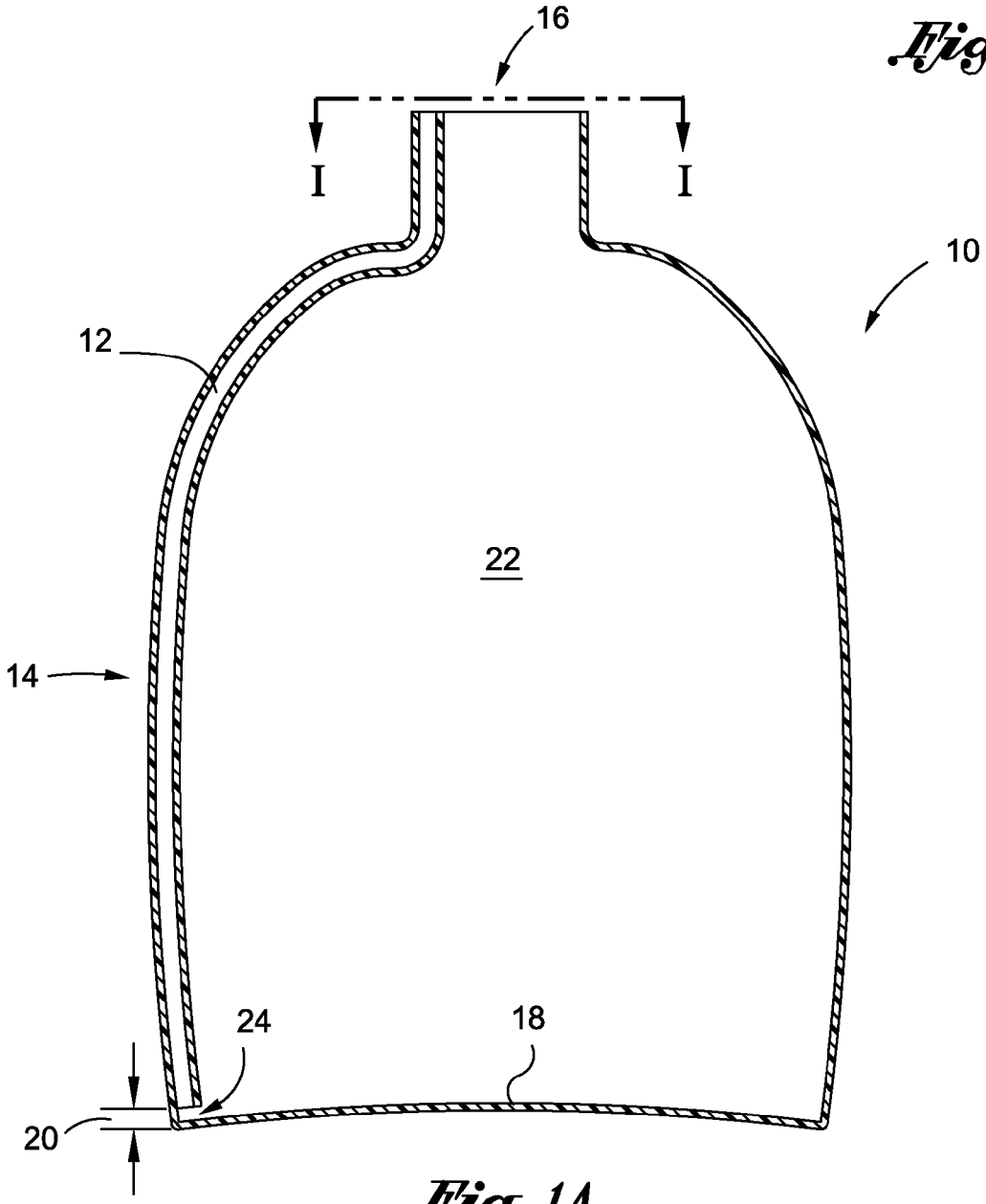
FIG. 1A shows a cross-sectional view of a bottle having an integral dip tube in accordance with an embodiment of the present invention.

Referring to FIG. 1A and FIG. 1B, there are shown cross-sectional and plan views, respectively, of an exemplary bottle 10 in accordance with the present invention. The bottle 10 may include an integral dip tube 12 formed along one side wall 14 of the bottle. The integral dip tube 12 may run along the side wall 14 from a top opening 16 of the bottle 10 toward a bottom 18 of the bottle 10.

The integral dip tube 12 may stop a distance 20 from the bottom 18 of the bottle 10 so as to be in fluid communication with an inside 22 of the bottle 10. The distance 20 may be selected so that a bottom end 24 of the integral dip tube 12 is far enough from the bottom 18 such that fluid in the bottle may be taken up through the integral dip tube 12. The distance 20 may be further selected so that the bottom end 24 is not too far from the bottom 18 of the bottle 10 such that there may remain fluid in the bottle 10 that is unable to be taken up through the integral dip tube 12. Typically, the distance 20 may be from about 0.5 to about 3 times a diameter 26 of the integral dip tube 12.

Figure 2A:
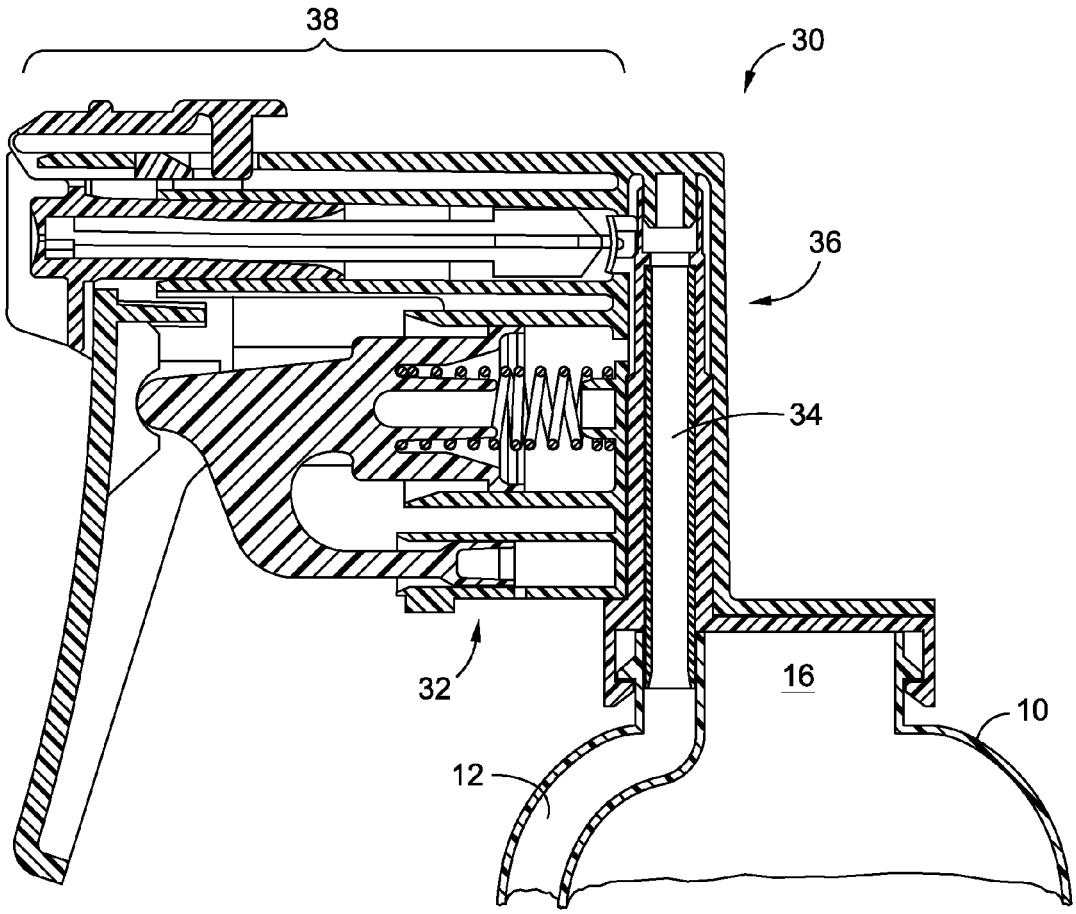
FIG. 2A shows a cross-sectional view of a fluid dispensing mechanism having a forward trigger mechanism, according to the present invention.

Typically, and as is shown in FIGS. 2A and 1A, the side wall 14 in which the integral dip tube 12 is formed may face out in the same direction as would a fluid spray exiting a trigger (described below) attached at the top opening 16 of the bottle 10. This configuration may be especially useful when the fluid from the bottle 10 is expelled therefrom by pointing the trigger downward. In this downward pointing configuration, a small amount of fluid may pool at the intersection of the side wall 14 and the bottom 18, thereby allowing even this small amount of fluid to be drawn up the integral dip tube 12.

While the present invention has been and is further described by having a side wall in which the integral dip tube 12 is formed facing the same direction in which the trigger points, other configurations may also be useful. For example, for a bottle that is typically used by pointing the trigger upwards, the integral dip tube 12 may be formed at the side wall 14 that faces opposite to the direction of expulsion of spray from a trigger attached to the bottle 10.

Referring specifically to FIG. 2A, there is shown a cross-sectional view of a fluid dispensing mechanism 30 having a forward trigger mechanism 32, according to the present invention. The fluid dispensing mechanism 30 may be attached to the bottle 10 by any typical means. For example, the fluid dispensing mechanism 30 may be snap-fit connected to the top opening 16 of the bottle 10, as shown in FIG. 2A. Alternatively, the fluid dispensing mechanism 30 may be attached to the bottle 10 by a nut (not shown) that may thread on the top opening 16 of the bottle 10.

Regardless of the mechanism of connection between the bottle 10 and the fluid dispensing mechanism 30, the fluid dispensing mechanism 30 of FIG. 2A may be described to have a forward trigger mechanism 32. Typical trigger mechanisms may have a trigger supply line centrally located about the top opening 16. The fluid dispensing mechanism 30 of the present invention, however, may have a straight trigger supply line 34 that is located other than centrally, such as at a rear end 36 of the fluid dispensing mechanism 30, or when attached to the bottle 10, adjacent to the side wall 14 of the top opening 16. In other words, the trigger engine 38 of the fluid dispensing mechanism 30 may be located forward of the trigger supply line 34, as shown in FIG. 2A. This configuration may allow the trigger supply line 34 to fit directly into the integral dip tube 12 of the bottle 10.

The fluid dispensing mechanism 30 may be any conventional device, that may be designed to have a forward trigger mechanism, for drawing fluid from a bottle up a dip tube and expelling the fluid outside of the bottle. The fluid dispensing mechanism 30 may be a pump or a trigger-operated sprayer, as shown in FIG. 2A. One example of a trigger-operated sprayer may be as disclosed in U.S. Pat. No. 5,794,822, herein incorporated by reference.

Figure 2B:
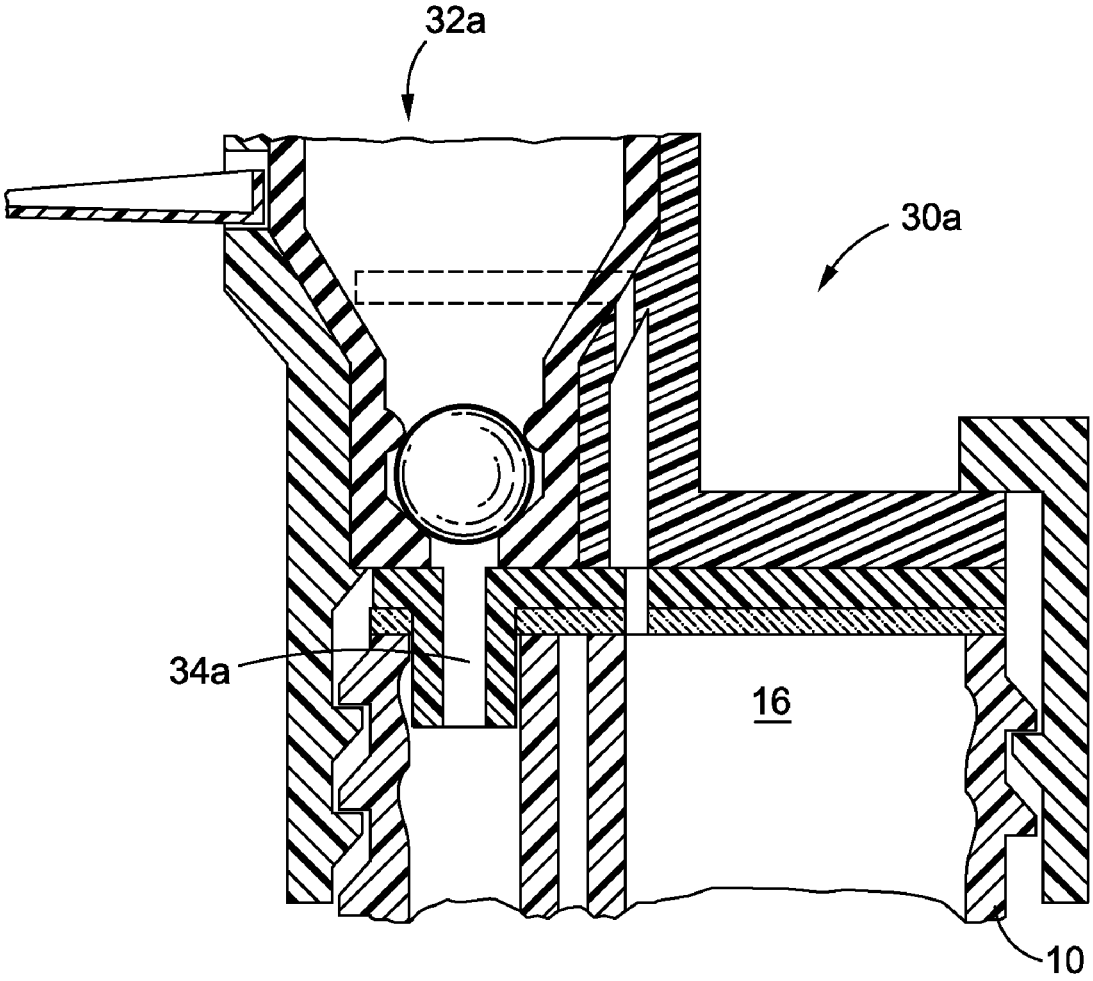
FIG. 2B shows a cross-sectional view of another fluid dispensing mechanism having a forward trigger mechanism, according to the present invention.

A further example of a fluid dispensing mechanism 30*a* is shown in FIG. 2B. This fluid dispensing mechanism 30*a* may be similar to that disclosed in U.S. Pat. No. 4,863,071, herein incorporated by reference. The present invention differs from that of the '071 patent in that the present invention may use a forward trigger mechanism 32*a* in order to align the trigger supply line 34*a* with the integral dip tube 12 of the bottle 10. Similar to the embodiment of FIG. 2A, fluid dispensing mechanism 30*a* may be attached to the bottle 10 by any typical means.

Figure 3:
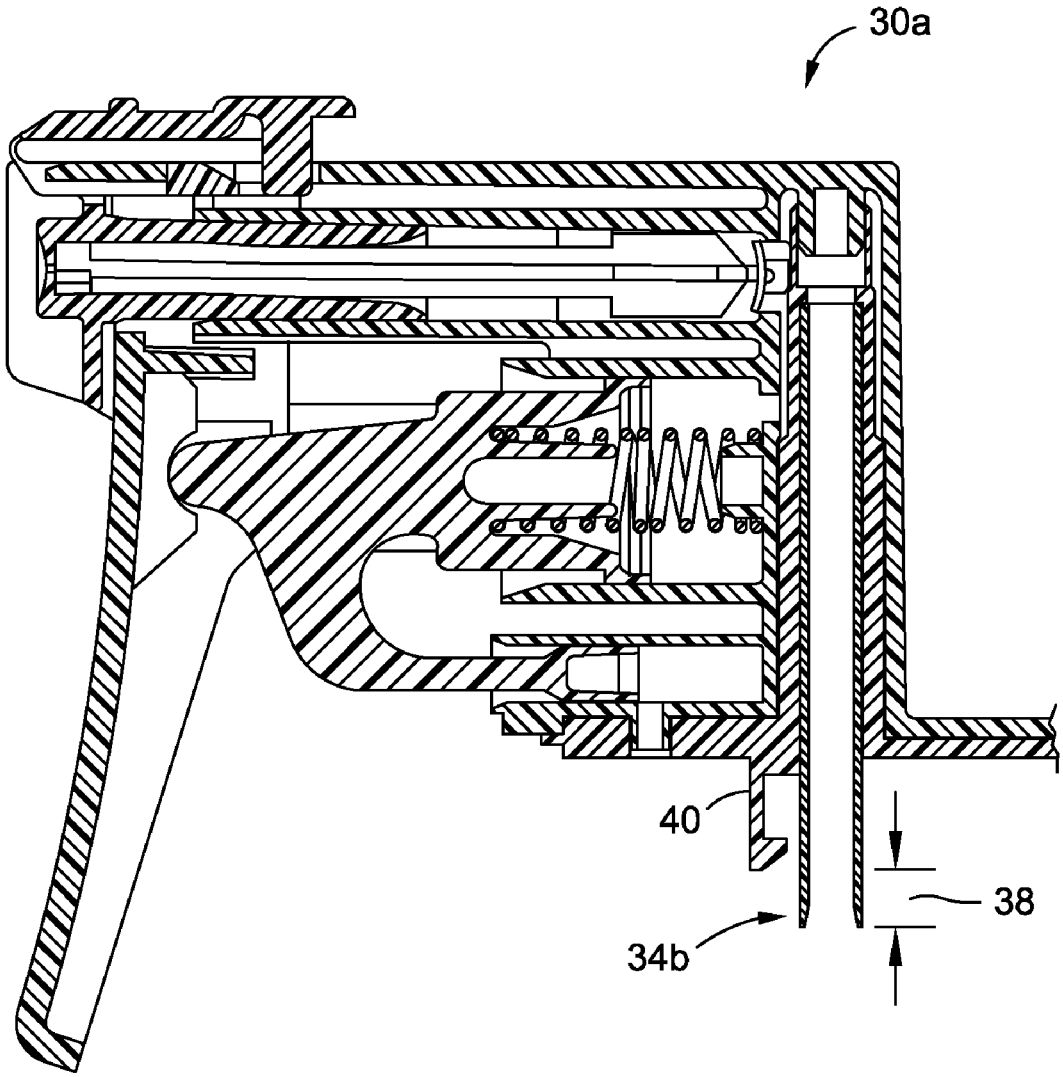
FIG. 3 shows a cross-sectional view of a fluid dispensing mechanism having a depending supply tube, according to the present invention.

Referring now to FIG. 3, there is shown the fluid dispensing mechanism 30*a* of FIG. 2B, without a bottle attached, and having a depending trigger supply line portion 34*b* which may extend a length 38 beyond an attachment portion 40 of the fluid dispensing mechanism 30*a*. This depending trigger supply line portion 34*b* may help to provide alignment between the integral dip tube 12 (see FIG. 2B) and the fluid dispensing mechanism 30*a* when the two components are connected. In this embodiment, the depending trigger supply line portion 34*b* may be placed into the integral dip tube 12 prior to fastening attachment portion 40 onto the bottle 10, thereby allowing a user to visually confirm alignment before the attachment portion 40 is fastened onto the bottle 10.

Figure 5:
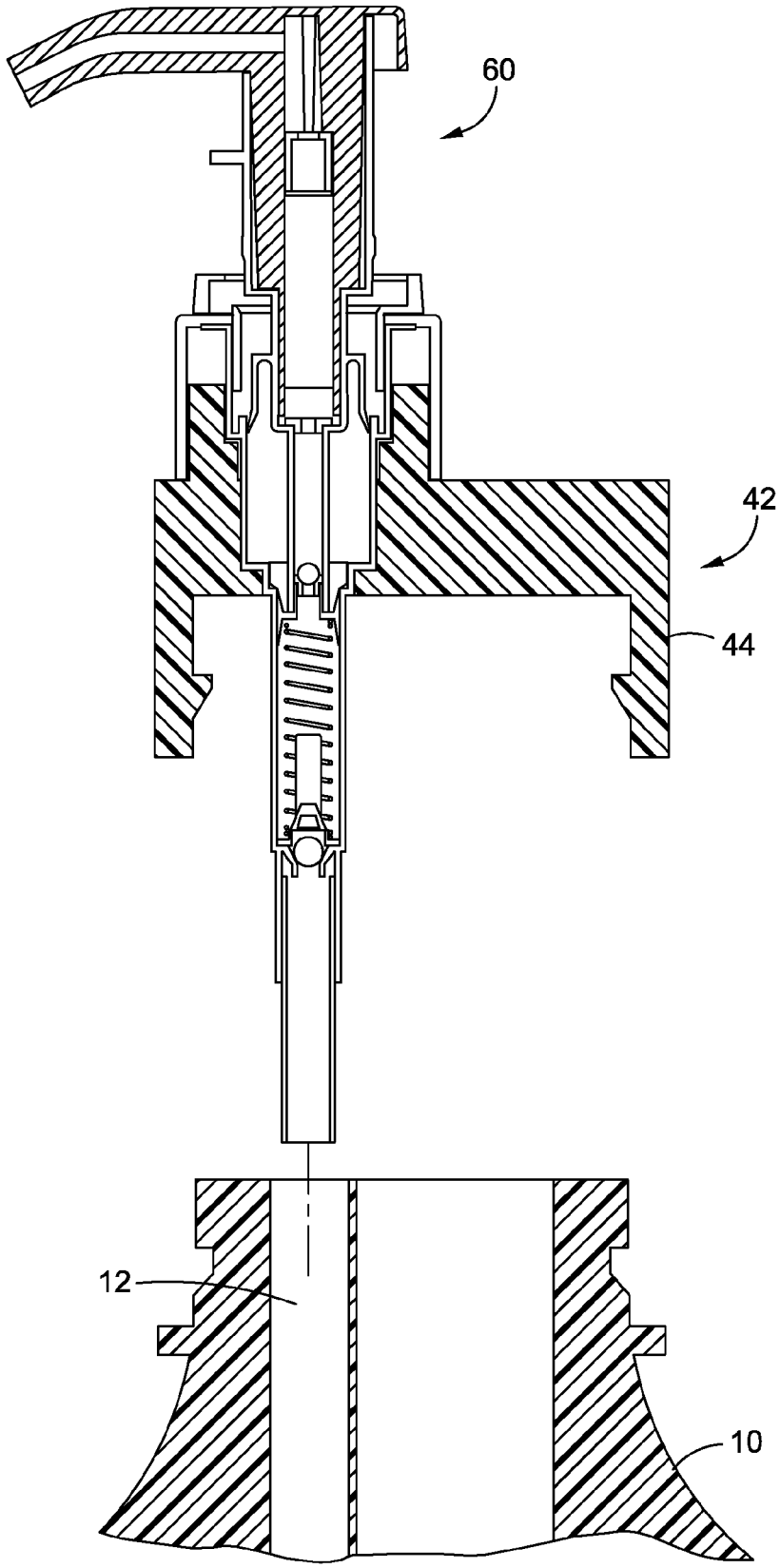
FIG. 5 shows the snap-fit fluid dispending mechanism of FIG. 4A used with a pump mechanism, according to the present invention.

As discussed above, most conventional fluid dispensing mechanism, such as pumps and trigger sprays, may be useful in certain embodiments of the present invention. For example, the present invention includes any fluid dispensing mechanism that has a forward trigger mechanism, as described above, that may be used with a bottle having an integral dip tube. The present invention may additionally include a pump mechanism, for example as shown in FIG. 5, and described in U.S. Pat. No. 6,644,516 to Foster et al., and incorporated by reference herein. Furthermore, the present invention includes any fluid dispensing mechanism, regardless of the location of the trigger mechanism, that may be attached through a snap-fit connection to a bottle with an integral dip tube. In addition, the present invention, in certain embodiments thereof, may not be limited to any particular means for attaching the fluid dispensing mechanism to the bottle.

Figure 4A:
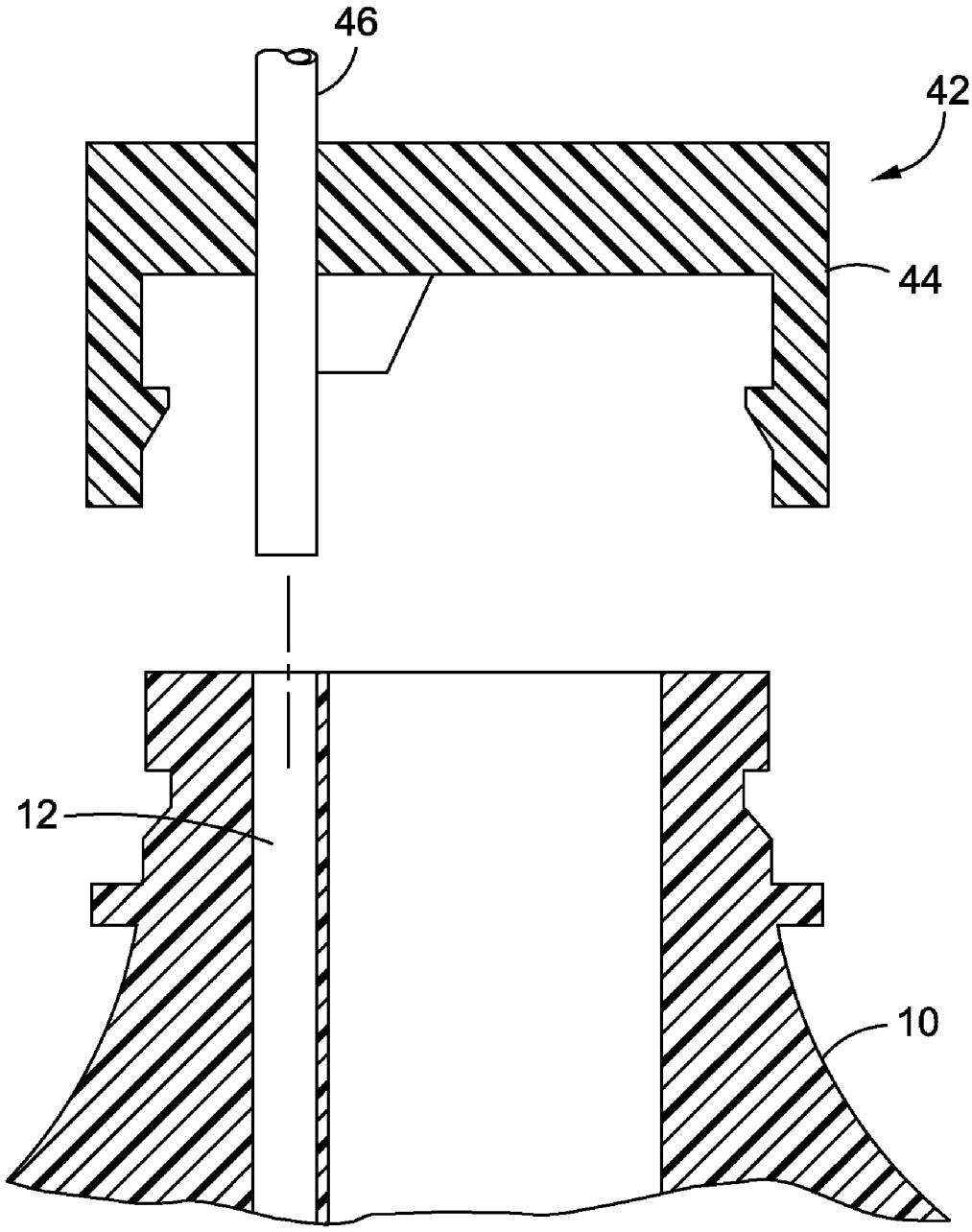
FIG. 4A shows a cross-sectional view of a snap-fit fluid dispensing mechanism having a forward trigger mechanism, according to the present invention.

Referring to FIG. 4A, there is shown one example of a connection that may be made between a fluid dispensing mechanism 42 (an attachment portion 44 and a trigger supply line 46 only being shown) and a bottle 10. As previously described, the bottle 10 may include integral dip tube 12. In the example of FIG. 4A, the fluid dispensing mechanism 42 may be connected to the bottle 10 via a snap-fit mechanism. One example of a snap-fit mechanism that may be useful in the present invention is described in commonly owned U.S. patent application Ser. No. 12/142,090, herein incorporated by reference.

Similar to the embodiments of FIGS. 2A and 2B, the embodiment shown in FIG. 4A has the trigger supply line 46 offset from center, thereby allowing "direct alignment" between the trigger supply line 46 and the integral dip tube 12 when the fluid dispensing mechanism 42 is snap-fit onto the bottle 10. Unlike prior art designs, which require an offset supply tube to fluidly connect the dip tube with the centrally-located trigger supply line of the fluid dispensing mechanism, the "direct alignment"of the present invention, by having an offset trigger supply line 46 to directly fluidly connect with the integral dip tube 12, eliminates the need for such an offset supply tube. The trigger supply line 46 may be depending, as in the example of FIG. 3, to help in alignment of the trigger supply line 46 with the integral dip tube 12. Alternatively, this alignment may be achieved by any means known in the art, such as a tab and slot-type alignment (not shown).

Figure 4B:
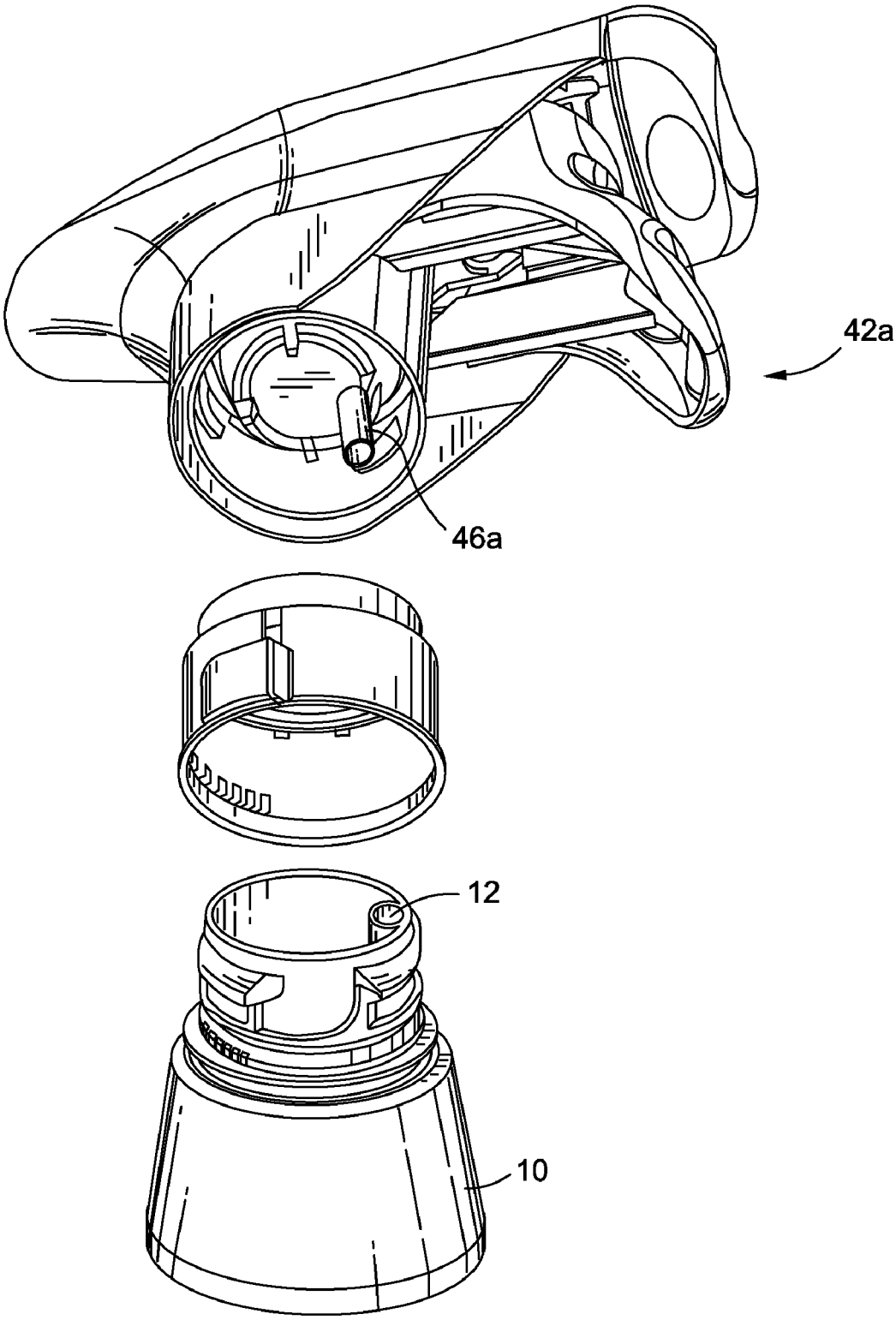
FIG. 4B shows a cross-sectional view of a bayonet snap-fit fluid dispensing mechanism having a central trigger mechanism, according to the present invention.

Referring now to FIG. 4B, there is shown a further example of a connection that may be made between a fluid dispensing mechanism 42*a* and a bottle 10. This type of connection is one example of a bayonet-type fitment that is known in the art. Bayonet-type fitments, such as those disclosed in, for example, U.S. Pat. Nos. 6,138,873 and 6,226,068, may be useful in the present invention for attaching the fluid dispensing mechanism 42*a* with the bottle 10.

Similar to the embodiments of FIGS. 2A and 2B, the embodiment shown in FIG. 4B has the trigger supply line 46*a* offset from center, thereby allowing the same type of direct alignment as described for the embodiment of FIG. 4A. This direct alignment may allow a direct fluid connection between the trigger supply line 46*a* and the integral dip tube 12 when the fluid dispensing mechanism 42*a* is connected to the bottle 10.

Figure 4C:
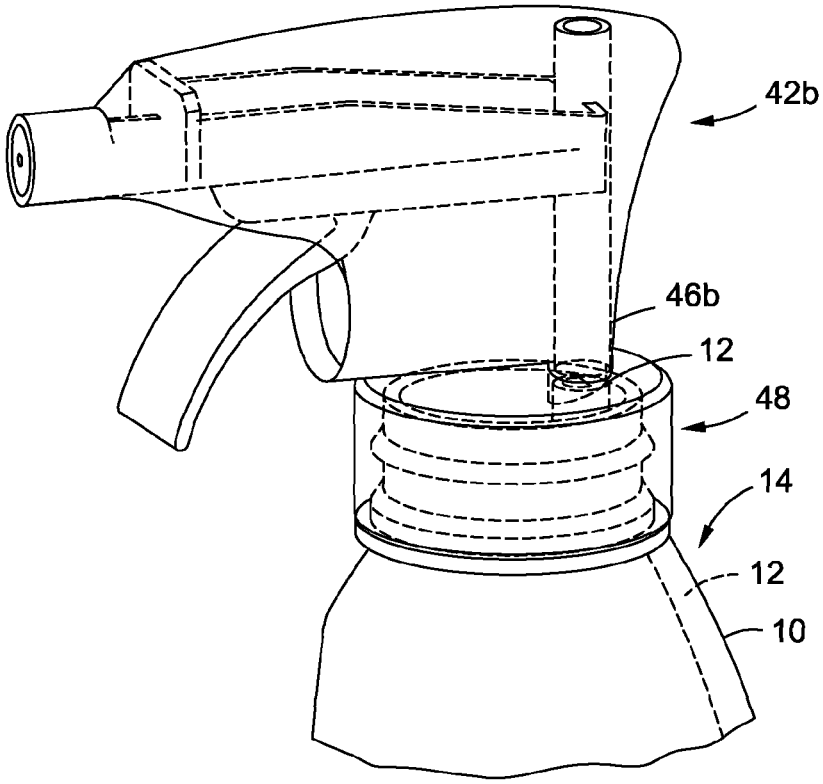
FIG. 4C shows a cross-sectional view of a non-removable snap-fit fluid dispensing mechanism having a backward trigger mechanism, according to the present invention.

Referring to FIG. 4C, there is shown another example of a connection that may be made between a fluid dispensing mechanism 42*b* and the bottle 10. In this example, the attachment portion 48 provides a non-removable connection between the fluid dispensing mechanism 42*b* and the bottle 10. Similar to the embodiments of FIGS. 2A and 2B, the embodiment shown in FIG. 4C has the trigger supply line 46*b* offset from center, thereby allowing direct alignment between the trigger supply line 46*b* and the integral dip tube 12 when the fluid dispensing mechanism 42*b* is snap-fit onto the bottle 10.

It should be noted that, while previous figures show the integral dip tube 12 in a "forward" configuration, as described above, FIG. 4C shows an example of the integral dip tube being in a "rearward" configuration. In other words, when the fluid dispensing mechanism 42*b* is attached to the bottle 10 and the trigger supply line 46*b* is fluidly connected to the integral dip tube 12, use of the fluid dispensing mechanism 42*b* may expel fluid from the bottle 10 in a direction that is away from the side 14 of the bottle wherein the integral dip tube 12 is formed. As discussed above, this configuration may be useful when the user desires to direct fluid from the bottle 10 in an upward direction.

Figure 4D:
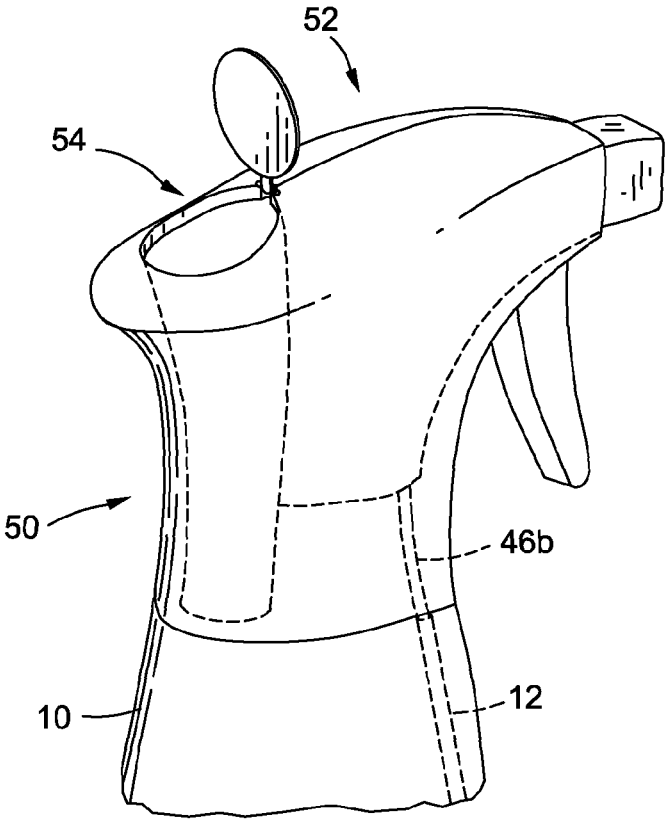
FIG. 4D shows a cross-sectional view of a snap-fit fluid dispensing mechanism, having a forward trigger mechanism, with a fluid refill channel formed therethrough, according to the present invention.

Referring to FIG. 4D, there is shown a cross-sectional view of a snap-fit fluid dispensing mechanism 50, having a forward trigger mechanism 52, with a fluid refill channel 54 formed therethrough, according to the present invention. Similar to the previous embodiments described herein, the bottle 10 may have integral dip tube 12 formed therein. The forward trigger mechanism 52 allows for the rearward fluid refill channel 54 and a straight direct alignment of the trigger supply line 46*b* with the integral dip tube 12. The fluid dispensing mechanism 50 may be attached to the bottle 10 by any of the above described means, typically via a non-removable snap-fit connection. The fluid refill channel 54 may permit the user to add additional fluid into the bottle 10, thereby allowing reuse of the bottle 10 and the fluid dispensing mechanism 50 over multiple bottle refills.

As discussed above, a fluid dispensing mechanism, as used with the present invention, may be a trigger-type sprayer, as shown, for example, in FIG. 2A. Alternatively, the fluid dispensing mechanism may be a pump-type dispenser 60, as shown in FIG. 5. The pump-type dispenser 60 may be attached to any of the previously described attachment portions (for example, attachment portion 44 of FIG. 4A, as shown in FIG. 5).

The above described examples of embodiments of the present invention may impart several advantages over conventional dispensers presently being sold. The use of a snap-fit fluid dispensing mechanism (having, for example, attachment means 44) may provide, once the fluid dispensing mechanism is aligned with the bottle, for alignment of the trigger supply line 46 with the integral dip tube 12 as well as attachment and sealing of the fluid dispensing mechanism with the bottle, with a single motion. Conventional bottles with integral dip tubes have screw caps that require a user to first align the fluid dispensing mechanism with the dip tube and then twist the cap to provide a seal. These conventional bottles also require the user to maintain the alignment of the dip tube with the fluid dispensing mechanism while the screw cap is tightened onto the bottle. In conventional bottles, the alignment of the dip tube with the fluid dispensing mechanism may be lost due to the torque applied to the screw cap. The snap-fit fluid dispensing mechanism of the present invention, when applied to a bottle having an integral dip tube, may be simply snapped in place, without the need to apply torque to the cap to seal the cap, as is required with conventional screw caps.

Moreover, these conventional bottles require a means to move the fluid from the side of the open top part of the bottle (where the integral dip tube is located), to a central portion of the trigger mechanism. With the use of a forward trigger mechanism according to the present invention, as described above, this fluid moving means otherwise required by conventional bottles may be avoided.

One embodiment of the present invention may use an offset trigger mechanism, such as a forward trigger mechanism, to directly align the trigger supply line with the integral dip tube of the bottle. Thus, with the bottle and trigger mechanism of the present invention, the trigger mechanism may be snapped onto the bottle in a straight-on, one motion manner, without requiring both an alignment step followed by a rotation step, as is required with screw-on caps presently used with bottles having integral dip tubes.

One embodiment of the present invention, including a snap-fit trigger mechanism, may also help maintain seal integrity in shipping and in use when compared to the screw-on caps presently used with bottles having integral dip tubes. Problems with the screw-on caps becoming loosened during use or transport may be avoided with the snap-on caps of the present invention.

This invention has been described herein in detail to provide those skilled in the art with information relevant to apply the novel principles and to construct and use such specialized components as are required. However, it is to be understood that the invention can be carried out by different equipment, materials and devices, and that various modifications, both as to the equipment and operating procedures, can be accomplished without departing from the scope of the invention itself.

We claim:

1. A fluid dispensing container comprising:

a bottle having a closed bottom and a top opening;

the bottle being formed with an integral dip tube, the integral dip tube having a first end in fluid communication with the closed bottom of the bottle and a second end, the integral dip tube second end contained within a perimeter of the bottle top opening as seen from top plan view;

a fluid dispensing mechanism including a snap-fit attachment portion and a fluid supply line; and wherein:

the snap-fit attachment portion including an open bottom configured for attaching the fluid dispensing mechanism to the bottle top opening;

the fluid supply line extending a distance below the open bottom of the snap-fit attachment portion; and the fluid supply line is receivingly engaged within the second end of the integral dip tube when he fluid dispensing mechanism is attached to the bottle top opening.

2. The fluid dispensing container of claim 1, wherein the fluid dispensing mechanism includes a trigger engine located forward of the supply line.

3. The fluid dispensing container of claim 1, wherein the snap-fit attachment portion is a bayonet connector.

4. The fluid dispensing container of claim 1, wherein the snap-fit attachment portion is non-removable snap-fit connector.

5. The fluid dispensing container of claim 1, wherein the snap-fit fluid dispensing mechanism includes a refill channel formed therethrough and which allows refill of the bottle through the refill channel without removal of the snap-fit fluid dispensing mechanism from the bottle.

6. The fluid dispensing container of claim 1, wherein the snap-fit fluid dispensing mechanism is a trigger-type sprayer.

7. The fluid dispensing container of claim 1, wherein the snap-fit fluid dispensing mechanism is a pump dispenser.

8. The fluid dispensing container of claim 1, wherein the snap-fit attachment portion defines a single sealing attachment of the fluid dispensing mechanism to the bottle.

9. A fluid dispensing assembly for use in combination with a bottle having an integral dip tube in which an open top end of the dip tube is contained within a perimeter of a top opening of the bottle as seen in plan view, the fluid dispensing assembly comprising:

a fluid dispensing mechanism including a snap-fit attachment portion and a fluid supply line;

the snap-fit attachment portion including an open bottom configured for attaching the fluid dispensing mechanism to the bottle top opening;

the fluid supply line extending a distance below the open bottom of the snap-fit attachment portion for aligning with the open top end of the integral dip tube; and wherein the fluid supply line is receivingly engaged within the open top end of the integral dip tube upon attachment of the fluid dispensing mechanism to the bottle top opening.

10. The fluid dispensing container of claim 9, wherein the fluid dispensing mechanism includes a trigger engine located forward of the supply line.

11. The fluid dispensing container of claim 9, wherein the supply line is adjacent to a side wall of the open top of the bottle.

12. The fluid dispensing container of claim 9, wherein the fluid dispensing mechanism is non-removably attached to the bottle.

13. The fluid dispensing container of claim 9, wherein the fluid dispensing mechanism includes a refill channel formed therethrough, allowing, refill of the bottle through the refill channel without removal of the fluid dispensing mechanism from the bottle.

14. The fluid dispensing container of claim 9, wherein alignment of the fluid supply line with the integral dip tube and attachment of the fluid dispensing mechanics to the bottle takes place in a single motion.

15. The fluid dispensing container of claim 9, wherein the snap-fit attachment portion defines a single sealing attachment of the fluid dispensing mechanism to the bottle.

* * * * *